US007531952B2

(12) United States Patent
Kawanami et al.

(10) Patent No.: US 7,531,952 B2
(45) Date of Patent: May 12, 2009

(54) DISPLAY PANEL DEVICE

(75) Inventors: Yoshimi Kawanami, Kawasaki (JP); Nobuyuki Hori, Kawasaki (JP); Atsuo Ohsawa, Kawasaki (JP); Fumihiro Namiki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 384 days.

(21) Appl. No.: 11/044,611

(22) Filed: Jan. 28, 2005

(65) Prior Publication Data

US 2005/0200264 A1 Sep. 15, 2005

(30) Foreign Application Priority Data

Jan. 30, 2004 (JP) ..... 2004-024837

(51) Int. Cl.
*H01J 17/04* (2006.01)

(52) U.S. Cl. ..... 313/466; 313/473; 313/582

(58) Field of Classification Search ..... 313/582–587; 315/169.4; 345/37, 41, 60
See application file for complete search history.

(56) References Cited

U.S. PATENT DOCUMENTS

| | | | | |
|---|---|---|---|---|
| 5,505,801 | A | 4/1996 | Harris | |
| 5,841,227 | A | 11/1998 | Terpin | |
| 6,235,398 | B1 * | 5/2001 | Nakamura et al. | 428/432 |
| 6,833,665 | B2 | 12/2004 | Wachi et al. | |
| 6,855,369 | B2 * | 2/2005 | Nakamura et al. | 427/164 |
| 2002/0025441 | A1 * | 2/2002 | Hieda et al. | 428/440 |
| 2002/0050321 | A1 | 5/2002 | Tone et al. | |
| 2003/0184225 | A1 | 10/2003 | Namiki et al. | |

FOREIGN PATENT DOCUMENTS

| | | |
|---|---|---|
| EP | 0 999 536 | 5/2000 |
| EP | 1 134 072 | 9/2001 |
| EP | 1 180 781 | 2/2002 |
| EP | 1 379 118 | 1/2004 |
| JP | 2001-337614 | 12/2001 |
| JP | 2001-343898 | 12/2001 |
| JP | 2002-55626 | 2/2002 |
| JP | 2002-123182 | 4/2002 |
| JP | 2002-319351 | 10/2002 |
| JP | 2003-295779 | 10/2003 |
| TW | 554371 | 9/2003 |

OTHER PUBLICATIONS

KIPO Official Communication issued with respect to Korean Counterpart Application No. 10-2005-7944 dated May 22, 2006.
TIPO Official Letter issued in R.O.C. Patent Application No. 94102670 dated May 3, 2006.

* cited by examiner

*Primary Examiner*—Nimeshkumar D. Patel
*Assistant Examiner*—Christopher M Raabe
(74) *Attorney, Agent, or Firm*—Staas & Halsey LLP

(57) ABSTRACT

A front sheet that is a layered film glued on a front face of a display panel includes a front portion made of plural layers having the same plane size and different functions and a rear portion having a plane size smaller than the front portion and larger than the screen, and the rear portion is put on the front face of the display panel.

12 Claims, 7 Drawing Sheets

DISPLAY PANEL DEVICE

BACKGROUND OF THE INVENTION

1. Field of the Invention

The present invention relates to a display panel device including a flat display panel and a front sheet that is glued on the display panel.

2. Description of the Prior Art

Technology development of a plasma display panel (PDP) that is a self-luminous device is directed to a large screen for providing more powerful display. One of the important tasks for a large screen is weight reduction of the panel.

In general, a display device including a plasma display panel has a filter plate having a base of a tempered glass. This filter plate is arranged in front of the plasma display panel with air gap. The filter plate has various functions of adjusting a display color optically, preventing reflection of external light, shielding electromagnetic waves, and shielding near infrared rays concerning displaying operation and a function of protecting the plasma display panel mechanically. However, the filter plate is not suitable for a large screen of the plasma display panel because it has a large weight.

In order to reduce a weight of the display device, another structure is proposed in which a filter film having a base of a resin film is glued directly on the front face of the plasma display panel instead of the filter plate. Japanese unexamined patent publication No. 2001-343898 discloses a front face filter that includes a transparent conductive film for reducing electromagnetic wave radiation noise and a anti-reflection film that is glued on the front side of the transparent conductive film. A plane size of the anti-reflection film is smaller than a plane size of the transparent conductive film, and the peripheral portion of the transparent conductive film is not covered with the anti-reflection film. The peripheral portion of the transparent conductive film is connected to a conductive housing, so that electromagnetic wave energy flows from the transparent conductive film to the housing in the form of current and disappears.

It is difficult to realize plural functions by a single layer necessary for the front face of the display panel. The functions include improving optical characteristics of the screen, shielding EMI (Electro Magnetic Interference) and protecting the screen mechanically. In order to provide a display panel device having plural functions required by a specification, it is necessary to glue a multi-layered film on the front face of the display panel. In addition, it is also important to provide it at low cost.

SUMMARY OF THE INVENTION

An object of the present invention is to provide a structure of a display panel device that can satisfy functions easily and has good productivity.

According to the present invention, a structure of the front sheet that is a layered film glued on a front face of the display panel includes a front portion that has a plurality of laminated layers having the same plane size and different functions and a rear portion having a plane size smaller than the front portion and larger than the screen, and the rear portion is adjacent to the front face of the display panel.

The plane sizes of the plural layers are made the same as each other, and only one or no layer is permitted to have a nonuniform pattern, so that a method of winding plural films drawn out of plural rolls being put together on another roll (a roll-to-roll method) can be used for manufacturing the front portion. In the roll-to-roll method, a precise alignment is not required if the widths of the plural band-like films to be overlapped are made the same each other, so that multilayered film can be manufactured efficiently. In addition, plural sheets of a predetermined size can be obtained by one cut. The roll-to-roll method is suitable for laminated plural layers each of which has a thickness of 500 μm or less.

A plane size of the rear portion is smaller than that of the front portion, and the rear portion is arranged at the rear side of the front portion, so that the alignmnet accuracy required between the front portion and the rear portion can be relieved. It is because misalignment cannot be conspicuous. In particular, if translucency of the peripheral area of the front portion is low, the rim of the rear portion is hidden when viewed from the front. Therefore, an appearance is not deteriorated even if the rim of the rear portion is something indefinite in shape. In this case, painting method with low accuracy of pattern can be adopted for forming the rear portion. However, it is possible to form a sheet to be the rear portion in advance, and to glue the sheet on the front portion.

If the display panel is a plasma display panel, it is necessary to shield electromagnetic waves because a drive voltage for discharge is relatively high. A film having a conductive mesh is already developed, so it is possible to incorporate an electromagnetic wave shielding layer into the front portion. When the electromagnetic wave shielding layer is arranged as a lowest layer in the front portion, the peripheral area of the electromagnetic wave shielding layer can be exposed for connection with the conductive housing, and the function of preventing reflection or glare can be assigned to the top layer of the front portion.

If the front sheet is peelable from the display panel or if the front portion is peelable from the rear portion, it is possible to repair them by redoing the step of gluing them.

According to the present invention, a display panel device that can satisfy functions easily and has good productivity can be obtained.

DESCRIPTION OF THE PREFERRED EMBODIMENTS

Hereinafter, the present invention will be explained more in detail with reference to embodiments and drawings.

A plasma display panel that is useful as a color display device is a preferable object to which the present invention is applied. Hereinafter, an embodiment will be described in which a plasma display panel is used as a display panel.

EXAMPLE 1

Figure 1:
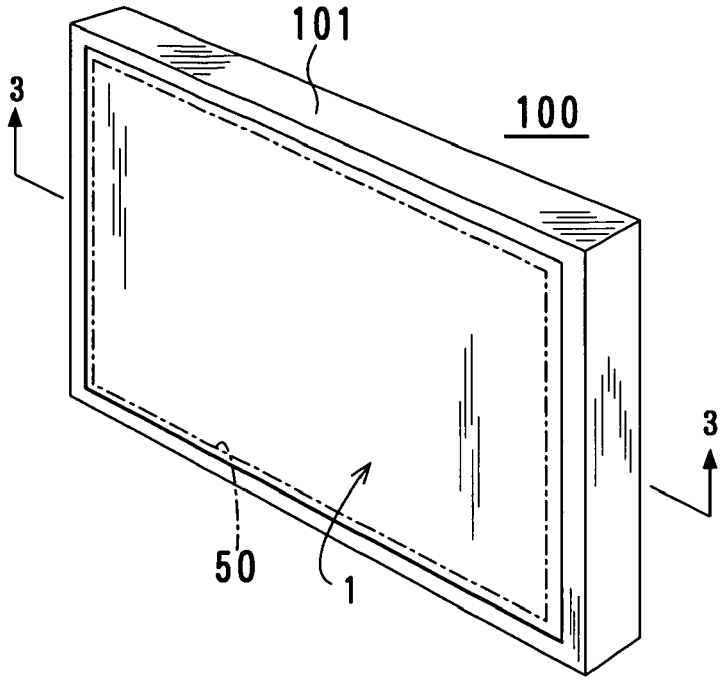
FIG. 1 shows an appearance of a display device according to the present invention.

FIG. 1 shows an appearance of a display device according to the present invention. A display device 100 is a flat type display having a 42-inch diagonal screen 50. A dimension of the screen 50 is 0.92 meters in the horizontal direction and 0.52 meters in the vertical direction. A facing cover 101 that defines a plane size of the display device 100 has an opening that is larger than the screen 50, so that a front face of a display panel device 1 is exposed in part.

Figure 2:
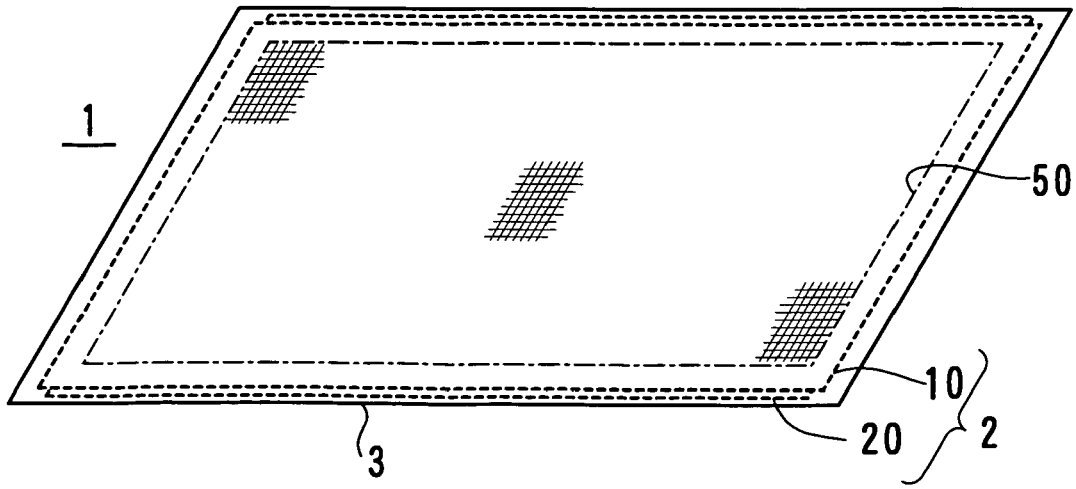
FIG. 2 shows a structure of a display panel device.

FIG. 2 shows a structure of the display panel device. The display panel device 1 includes a plasma display panel 2 that is a device that constitutes a screen and a front sheet 3 that is glued directly on the front face of the plasma display panel 2 to be a display surface. The plasma display panel 2 is a self-luminous type device that emits light by gas discharge, which includes a front face plate 10 and a rear face plate 20. Each of the front face plate 10 and the rear face plate 20 is a structural element having a base of a glass plate having a thickness of approximately 3 mm. There is no limitation of the structure of the plasma display panel 2 when embodying the present invention. Therefore, a description of an inner structure of the plasma display panel 2 is omitted here.

Figure 3:
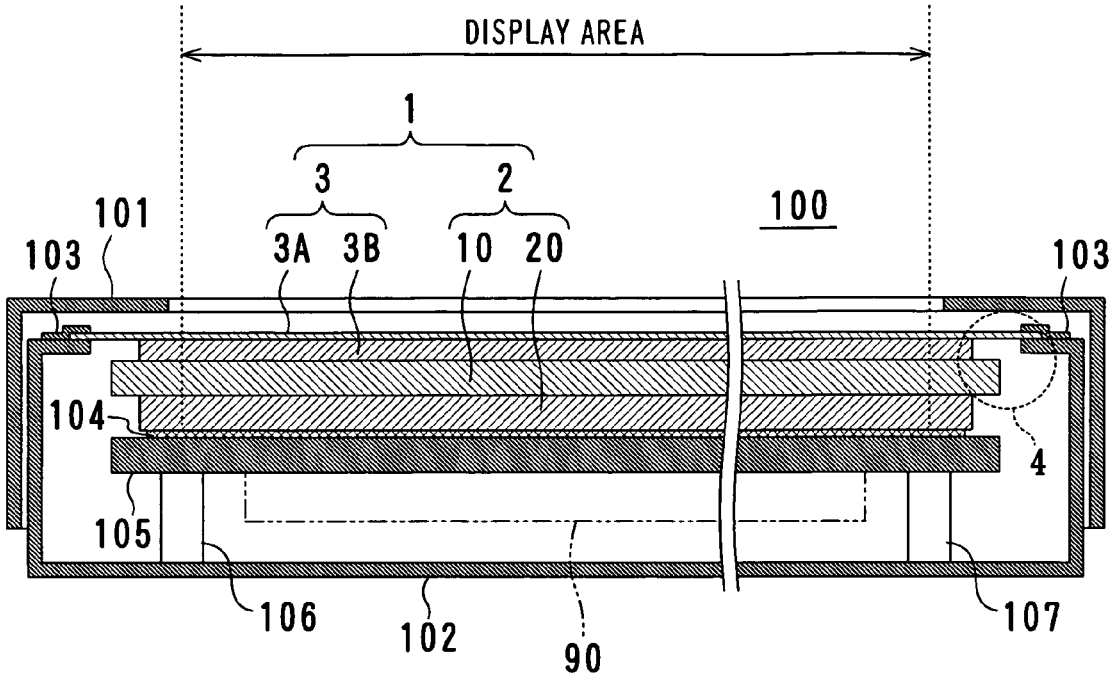
FIG. 3 shows a first example of the structure of the display device.
Figure 4:
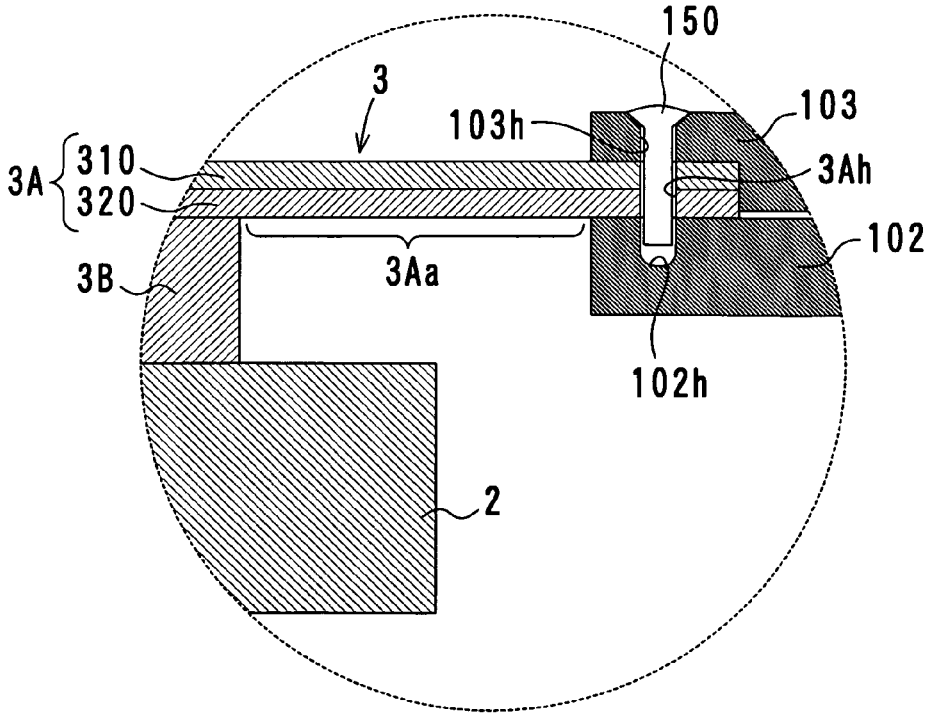
FIG. 4 shows a structure of a principal portion of the display device.
Figure 5:
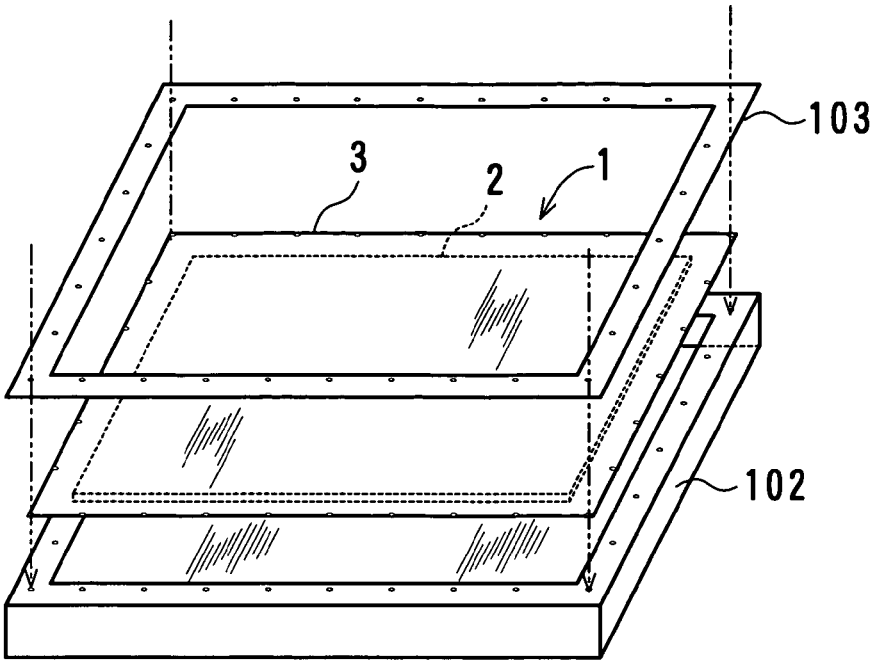
FIG. 5 shows an outline of fixing of a front sheet.

FIG. 3 shows a cross-sectional cut along the 3-3 line in FIG. 1, concerning the first example of a structure of the display device. FIG. 4 is an enlarged view of the portion encircled by the dot-dashed line in FIG. 3, concerning a structure of a principal portion of the display device. FIG. 5 shows an outline of fixing of the front sheet.

As shown in FIG. 3, the display device 100 includes a display panel device 1 arranged in a conductive housing 102 to which the facing cover 101 is attached. The display panel device 1 is attached to a chassis 105 made of aluminum via a thermal conducting adhesive tape 104, and the chassis 105 is fixed to the conductive housing 102 via spacers 106 and 107. A driving circuit 90 is arranged on the rear side of the chassis 105. A power source, a video signal processing circuit and an audio circuit are omitted in FIG. 3.

The front sheet 3 is a flexible layered film including a front portion 3A having a thickness of 0.2 mm and having a base of a resin film and a rear portion 3B having a thickness of 0.5 mm made of a resin layer that are put on each other, which will be described later. In particular, the thin front portion 3A that is a functional film having a multilayered structure has a good flexibility. The plane size of the front sheet 3, more specifically the plane size of the front portion 3A is larger than the plane size of the plasma display panel 2, so that the peripheral portion of the front portion 3A is positioned outside the plasma display panel 2. The plane size of the rear portion 3B is smaller than that of the front portion 3A and larger than that of the screen.

The conductive housing 102 is a metal plate molded in a boxed shape having a rectangular rear face, four side faces and a looped front face. It is also a conductive member surrounding the side faces and the rear face of the plasma display panel 2 apart from them (see FIG. 5). Inner rim of the front face of the conductive housing 102 is placed outside the plasma display panel 2 viewed from the front.

In the display device 100, the front sheet 3 extends along the plasma display panel 2 substantially in flat, and only the end portion thereof contacts the front face of the conductive housing 102. A looped pressure member 103 is disposed in front of the front sheet 3, which is sandwiched between the pressure member 103 and the front face of the conductive housing 102 so that the end portion of the front sheet 3 is fixed to the conductive housing 102. Actually, however, the end portion of the front portion 3A of the front sheet 3 is fixed to the conductive housing 102 as shown in FIG. 4. Here, the front portion 3A has an electromagnetic wave shielding layer 320. The electromagnetic wave shielding layer 320 is a rear side layer of the front portion 3A. A plane size of the front portion 3A is the same as that of the front sheet 3 and is larger than that of the rear portion 3B. Therefore, when the front sheet 3 is fixed to the conductive housing 102, the electromagnetic wave shielding layer 320 is connected to the conductive housing 102 electrically. The connection position thereof is apart from the plasma display panel 2.

As shown in FIG. 4 well, the plasma display panel 2 and the conductive housing 102 are connected to each other via a bridge portion 3A*a* of the front sheet 3. As the front sheet 3 has flexibility, a force that is applied to the plasma display panel 2 can be relieved by deformation of the portion 3A*a* when a relative position between the plasma display panel 2 and the conductive housing 102 is varied due to an impact pressure or heat. An influence on the connection between the front sheet 3 and the conductive housing 102 is also reduced. The deformation includes bending, contraction, expansion and twist.

As a method of fixing the end portion of the front sheet 3, it is preferable to use a plastic rivet 150 for mass production and reducing weight. It is preferable that the front sheet 3, the conductive housing 102 and the pressure member 103 are provided with holes 3Ah, 102*h* and 103*h*, respectively in advance, which are adapted to the rivet 150. Punching process can make many holes at the same time. Although a protrusion corresponding to a thickness of the pressure member 103 may be generated at the end portion of the front sheet 3, increase of a thickness of the display device 100 due to the protrusion is only approximately 1-2 mm.

Figure 6:
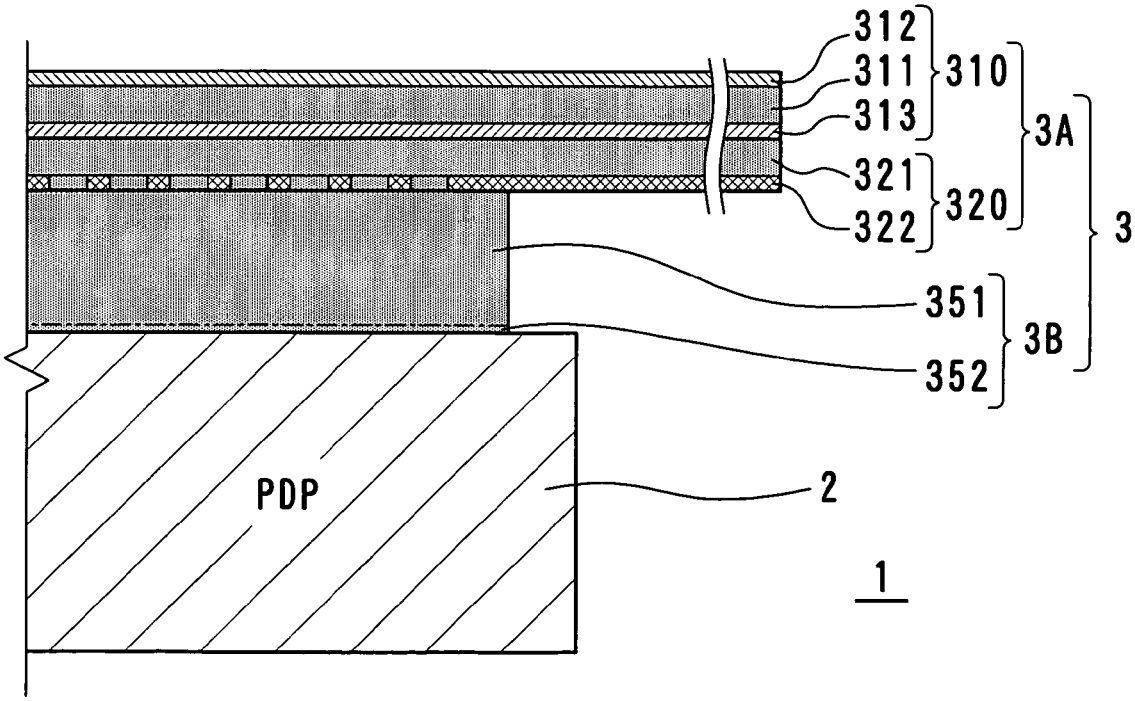
FIG. 6 shows a layer structure of the front sheet.

FIG. 6 shows a layer structure of the front sheet. The front sheet 3 is a layered film having a thickness of approximately 0.7 mm including an optical film layer 310 having a thickness of 0.1 mm, an electromagnetic wave shielding layer 320 having a thickness of 0.1 mm, an impact absorbing layer 351 having a thickness of 0.5 mm and an adhesive layer 352 having a thickness of a few microns in this order from the front face side. The optical film layer 310 and the electromagnetic wave shielding layer 320 constitute the front portion 3A, and the plane sizes of them are the same. A visible light transmittance of the entire front sheet 3 is approximately 40% after spectral luminous efficiency correction. The impact absorbing layer 351 and the adhesive layer 352 constitute the rear portion 3B. A weight of the front sheet 3 is approximately 500 grams, so the front sheet 3 is much lighter than the conventional filter plate (approximately 4.2 kilograms).

The optical film layer 310 includes a film 311 made of a PET (polyethylene terephthalate), a anti-reflection film 312 that is coated on the front side of the film 311, and a coloring layer 313 that is formed on the rear side of the film 311. The anti-reflection film 312 prevents reflection of external light. However, the function of the anti-reflection film 312 may be changed from AR (anti reflection) to AG (anti glare). The anti-reflection film 312 includes a hard coat for increasing scratch resistance of the surface of the sheet up to pencil hardness 4H. The coloring layer 313 adjusts visible light transmittance of red (R), green (G) and blue (B) for a color display and shields near infrared rays. The coloring layer 313 contains an infrared absorption coloring matter for absorbing light having a wavelength within the range of approximately 850-1100 nm, a neon light absorption coloring matter for absorbing light having a wavelength of approximately 580 nm and a coloring matter for adjusting visible light transmittance in a resin. An external light reflection factor of the optical film layer 310 is 3% after the spectral luminous efficiency correction, and the visible light transmittance is 55% after the spectral luminous efficiency correction. In addition, the infrared transmittance is 10% as an average in the wavelength range.

The electromagnetic wave shielding layer 320 includes a film 321 made of PET and a conductive layer 322 having a thickness of 10 microns that is a copper foil having a mesh portion. The visible light transmittance of an area of the conductive layer 322 that overlaps the screen is 80%. As the front surface of the conductive layer 322 is black, the electromagnetic wave shielding layer 320 looks substantially coal-black when it is viewed through the optical film layer 310.

The film 311 of the optical film layer 310 and the film 321 of the electromagnetic wave shielding layer 320 have a function of preventing a glass plate of the plasma display panel 2 from scattering when it is broken in an abnormal situation. In order to realize this function, it is preferable that a total thickness of the film 311 and the film 321 is 50 μm or more.

The impact absorbing layer 351 is made of a soft resin of an acrylic system, and a visible light transmittance thereof is 90%. The impact absorbing layer 351 is formed by applying the resin. When the resin is applied, it enters spaces of the mesh of the conductive layer 322, so that the conductive layer 322 becomes flat. Thus, scattering of light that may be generated by unevenness of the conductive layer 322 can be prevented.

The impact absorbing layer 351 made of the soft resin contributes to thinning of the front sheet 3. A test was conducted in which the display panel device 1 was placed on a horizontal hard floor, and an iron ball having a weight of approximately 500 grams was dropped on the center of the screen. An impact force just before the plasma display panel 2 was broken was approximately 0.40 J. When the plasma display panel 2 without the front sheet 3 was tested under the same condition, the result was approximately 0.13 J. When the display panel device in which only the optical film layer 310 was glued on the plasma display panel 2 was tested under the same condition, the result was approximately 0.15 J. Namely, an improved portion of the shock resistance due to the front sheet 3 is approximately 0.26 J, and most of the improvement that is approximately 0.24 J is obtained by the impact absorbing layer 351. The impact absorbing layer 351 having a thickness of 0.5 mm is practical.

In this example, a rear side surface portion of the resin layer that constitutes the impact absorbing layer 351 has a function as the adhesive layer 352. The impact absorbing layer 351 has relatively strong adhesiveness to the electromagnetic wave shielding layer 320 made of PET and copper. On the contrary, the adhesive layer 352 has loose adhesiveness to the glass surface that is the front face of the plasma display panel 2. The adhesion force thereof is approximately 2N/25 mm. When the front sheet 3 is peeled, the optical film layer 310 is not separated from the electromagnetic wave shielding layer 320 so that the front sheet 3 is separated from the plasma display panel 2 normally. "Normally" means that an even peeled surface without a visible remaining matter can be obtained.

Figure 7:
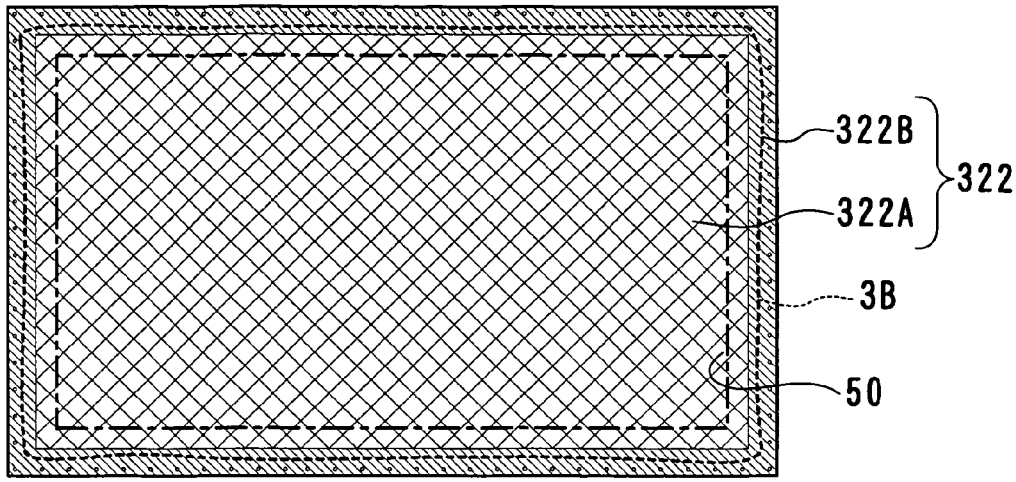
FIG. 7 shows a conductor pattern of an electromagnetic wave shielding layer schematically.

FIG. 7 shows a conductor pattern of the electromagnetic wave shielding layer schematically. The conductive layer 322 of the electromagnetic wave shielding layer is an integrated layer of a conductive mesh 322A that is put on the screen 50 and a looped conductive member 322B surrounding the conductive mesh 322A. A plane size of the conductive mesh 322A is larger than that of the screen 50. A width of four sides constituting the conductive member 322B is approximately 30 mm. The rear portion 3B of the front sheet is arranged so that the rim thereof overlaps the looped conductive member 322B along the entire length. Thus, the rim of the rear portion 3B is hidden behind the conductive member 322B when viewed from the front so that an even appearance is not deteriorated even if the contour of the rear portion 3B is something indefinite in shape. In forming the rear portion 3B, high accuracy is not required although the peripheral portion of the conductive member 322B must be exposed. A variation of approximately 10 mm can be permitted.

Note that although the conductive mesh 322A is drawn to be coarse in FIG. 7, an actual mesh pitch is substantially the same as the cell pitch of the screen 50, e.g., approximately 300 microns. It is possible to form alignment marks and rivet holes in the conductive member 322B without increasing the number of manufacturing steps of the conductive layer 322. The alignment marks facilitates the work for gluing the front sheet 3 on the plasma display panel 2.

Figure 8:
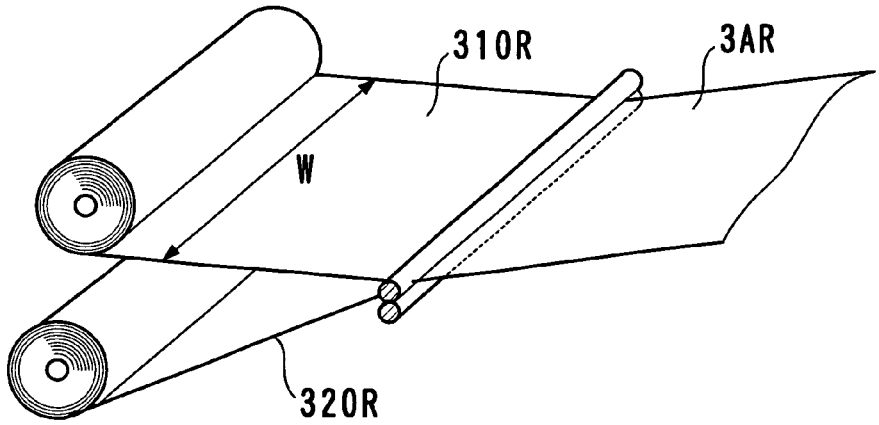
FIG. 8 shows a method for manufacturing a front portion of the front sheet.

FIG. 8 shows a method for manufacturing a front portion of the front sheet. The front portion is manufactured by a roll-to-roll method that is used for a multilayered film. A film 310R having a structure in which an optical film layer continues uniformly and a film 320R having a structure in which many electromagnetic wave shielding layer patterns are connected in a row are manufactured in rolls previously. The film 310R and the film 320R are drawn out of the rolls thereof and are put on each other. Thus, a multilayered film 3AR is obtained and wound in roll, which has a structure in which many front sheets are connected in a row. Here, although the film 320R has a specific pattern including a mesh, precise alignment of patterns between the film 310R and the film 320R is not necessary because the film 310R is uniform in a plan view. Namely, the structure of the front portion 3A includes only one or no nonuniform layer, which is a condition of applying the roll-to-roll method. As the width W of the film 310R is the same as the width W of the film 320R, alignment in the width direction is substantially neglected when putting them on each other in the roll-to-roll method. A little difference of widths and a little misalignment in the width direction between the films can be permitted.

Figure 9:
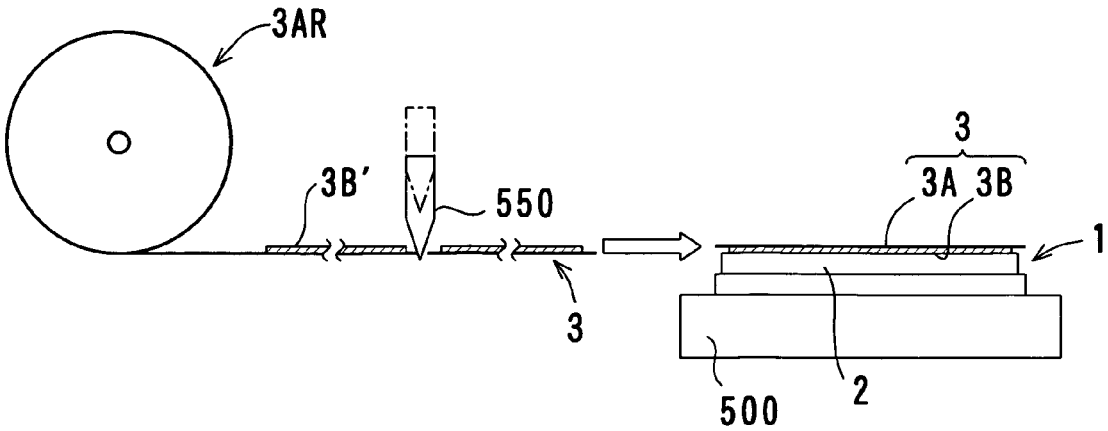
FIG. 9 shows a method for manufacturing the display panel device.

FIG. 9 shows a method for manufacturing the display panel device. The multilayered film 3AR is drawn out of the above-mentioned roll on which the multilayered film 3AR is wound, and a resin 3B' to be the rear portion is applied on the multilayered film 3AR. This multilayered film 3AR is cut by a cutter 550, and the obtained front sheet 3 is glued on a panel module that is placed on a table 500 after being tested. The panel module here means the plasma display panel 2 that is attached to the chassis 105. The plasma display panel 2 of the panel module and the front sheet 3 are integrated to be the completed display panel device 1. As another manufacturing method, it is possible that the multilayered film 3AR is reversed front side rear after the resin 3B' is applied on the same so that it is glued on the panel module, and then it is cut.

As the front portion 3A of the front sheet 3 is formed by cutting the multilayered film 3AR, at least one of the length and the width is the same completely between the optical film layer 310 and the electromagnetic wave shielding layer 320 that constitute the front portion 3A. If cutting of the multilayered film 3AR is performed by punching, the length as well as the width becomes completely the same.

If a foreign matter is found that entered a space between the front sheet 3 and the plasma display panel 2 after the display panel device 1 is completed, manufacturing yield of the display panel device 1 is still high because the front sheet 3 can be reglued. When the structure of the display panel device 1 is adopted, cost reduction by 20% or more can be realized compared with the case where the conventional filter plate is fixed to the front of the plasma display panel 2.

Concerning the device structure, there is a variation in which the conductive housing 102 is divided into the front portion and the rear portion, and the front portion is fixed to the chassis 105 via an insulator. In this variation, it is possible to reduce cost of the panel module by optimal design of the front sheet 3, the plasma display panel 2 and the driving circuit substrate on the common concept as elements of the panel module.

EXAMPLE 2

Figure 10:
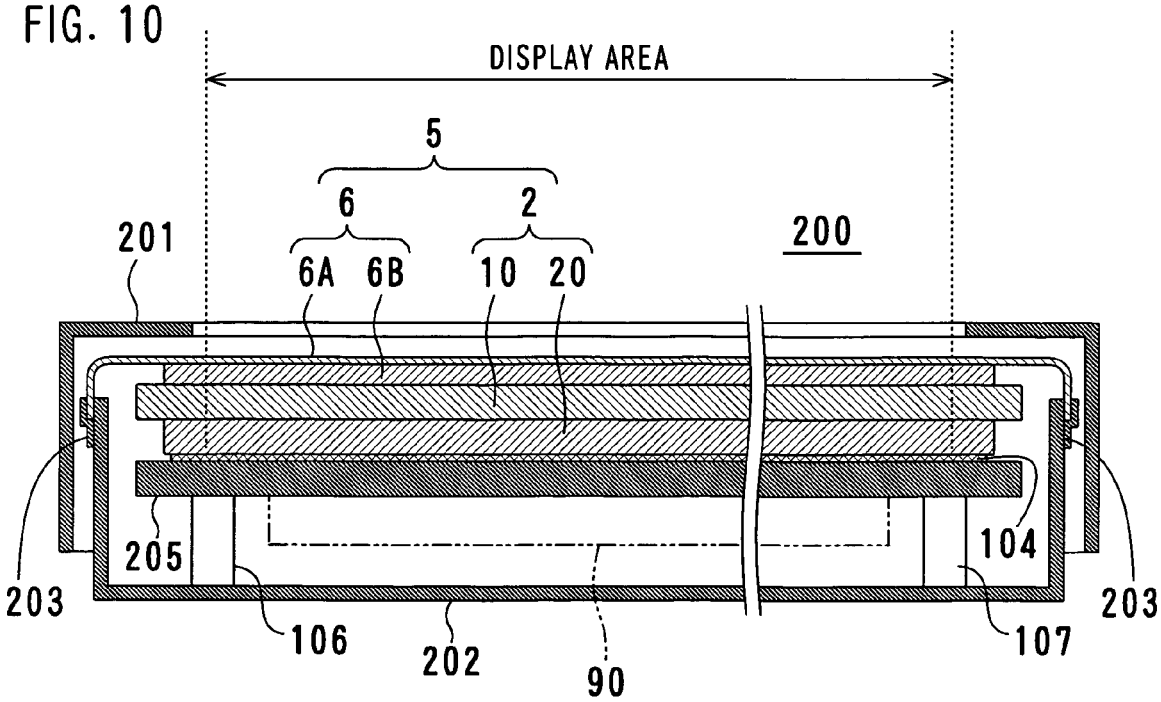
FIG. 10 shows a second example of a structure of the display device.

FIG. 10 shows a second example of a structure of the display device. A basic structure of the display device 200 is the same as the above-mentioned display device 100. In FIG. 10 and the following drawings, structural elements denoted by the same reference numerals as FIG. 3 are the same as the structural elements of the display device 100.

The display device 200 includes a display panel device 5 that is a screen module. The display panel device 5 includes the plasma display panel 2 and a front sheet 6, and the front sheet 6 includes a front portion 6A and a rear portion 6B. A layer structure of the front sheet 6 is the same as shown in FIG. 6. In the display device 200, a plane size of the front portion 6A is larger than the first example, and four side of the front portion 6A are bent to the rear side substantially in perpendicular manner so that the end portions of the front portion 6A are fixed to the conductive housing 202. The fixing is done by sandwiching the front portion 6A between the side face of the conductive housing 202 and the looped pressure member 203. The fixing position thereof is in rear of the front face of the plasma display panel 2 and away from the plasma display panel 2. In the fixing position, the electromagnetic wave shielding layer of the front portion 6A and the conductive housing 202 contact each other so that they are connected in conductive manner.

When the front portion 6A is bent, the fixing position becomes closer to the plasma display panel 2 than the case where it is not bent so that a plane size of the conductive housing 202 can be reduced. In addition, the fixing position becomes rear more than the case where the front portion 6A is not bent, so a thickness of the conductive housing 202 (size of the side face) can be reduced. Downsizing of the conductive housing 202 contributes to weight saving of the display device 200.

Note that if a factory that manufactures the display panel device 5 (a device manufacturer) and a factory that completes the display device 200 by assembling the display panel device 5 in the housing (a set manufacturer) are separated, it is necessary to prevent the front portion 6A from being damaged at the peripheral portion during transportation of the display panel device 5. For example, when the display panel device 5 is attached to the chassis 205 made of aluminum for being transported, a package size can be downsized by fixing the end portion of the front portion 6A to the chassis 205 via an insulator.

Figure 11:
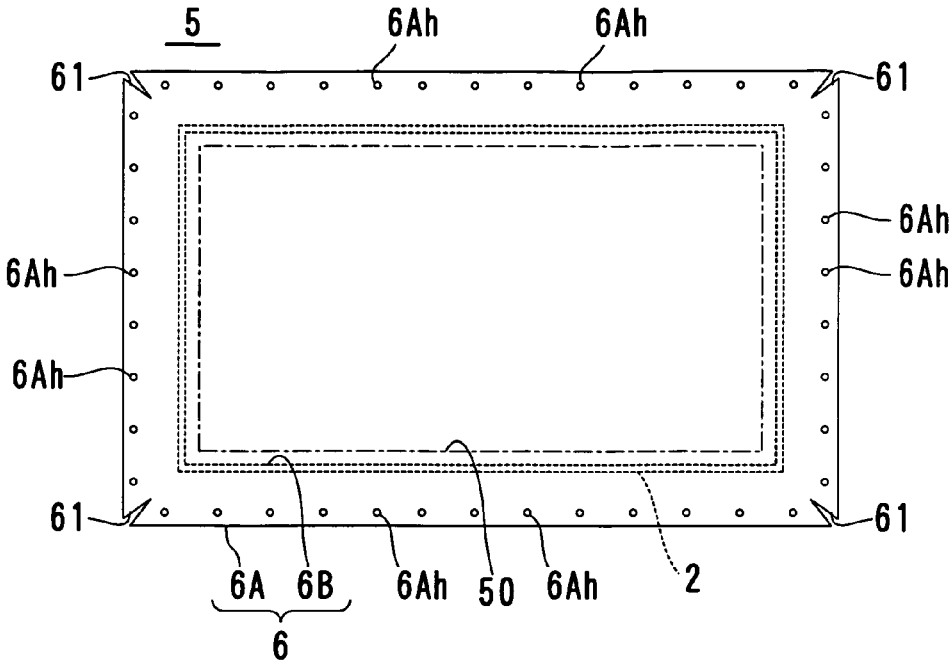
FIG. 11 shows an outline of a plane shape of the display panel device.

FIG. 11 shows an outline of a plane shape of the display panel device. The front sheet 6 of the display panel device 5 has notches 61 that are formed on four corners of the front portion 6A so as to facilitate the bending process of the front portion 6A. In addition, plural holes 6Ah are formed along the rim of the front portion 6A, and the holes 6Ah are used for fixing the front portion 6A.

EXAMPLE 3

Figure 12:
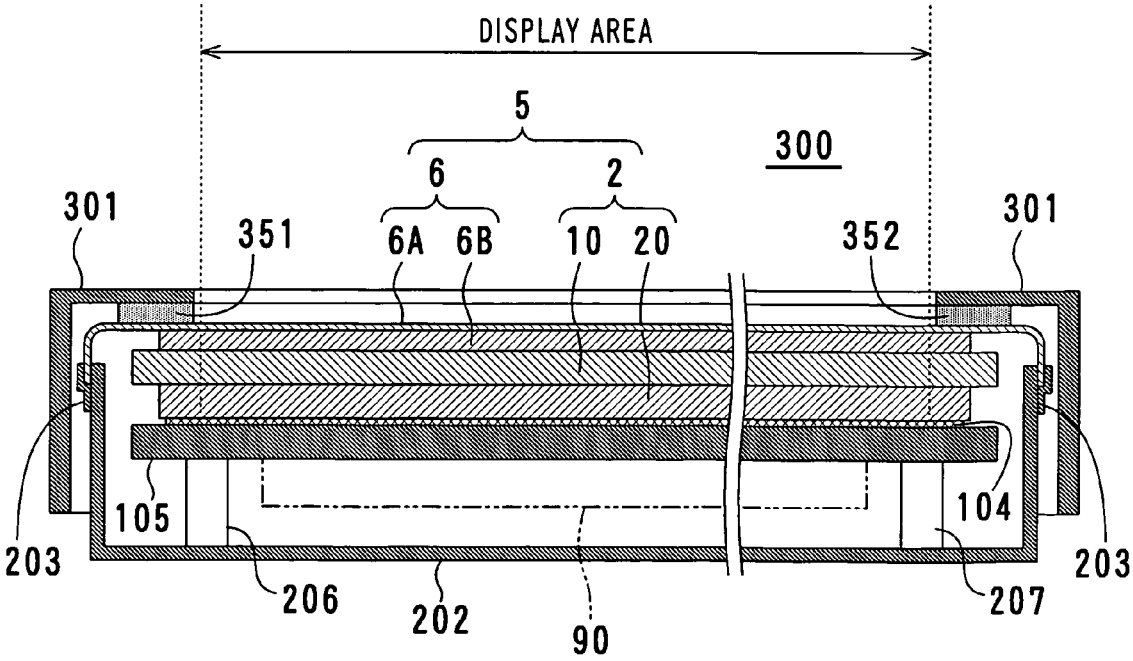
FIG. 12 shows a third example of a structure of the display device.

FIG. 12 shows a third example of a structure of the display device. A structure of the display device 300 is substantially the same as the above-mentioned display device 200. The display device 300 is characterized in that the inner rim of the front face of the facing cover 301 is close to a screen area, and sound absorbing members 351 and 352 are arranged between the facing cover 301 and the front sheet 6. The sound absorbing members 351 and 352 are glued on the facing cover 301 in advance, and the display panel device 5 is covered with the facing cover 301 so that the sound absorbing members 351 and 352 are pressed onto the front sheet 6. As the sound absorbing members 351 and 352 are flexible sponge, no excessive force is applied to the plasma display panel 2. As audible sound noises due to vibration of the plasma display panel 2 (called an abnormal sound) increases at a peripheral portion of the plasma display panel 2, the noises can be reduced substantially by arranging the sound absorbing members 351 and 352. Although the abnormal sound can be shielded by the filter plate in the conventional structure in which the filter plate is arranged in front of the plasma display panel, the sound can be reflected by the filter plate and propagate from the rear side to the front side. On the contrary, as the abnormal sound is absorbed substantially completely in the display device 300, quiet display environment can be obtained. Sounds generated by the plasma display panel 2 propagate along the rear portion 6B that is glued on the plasma display panel 2, so it is preferable to arrange the sound absorbing members 351 and 352 to overlap the rear portion 6B.

EXAMPLE 4

Figure 13:
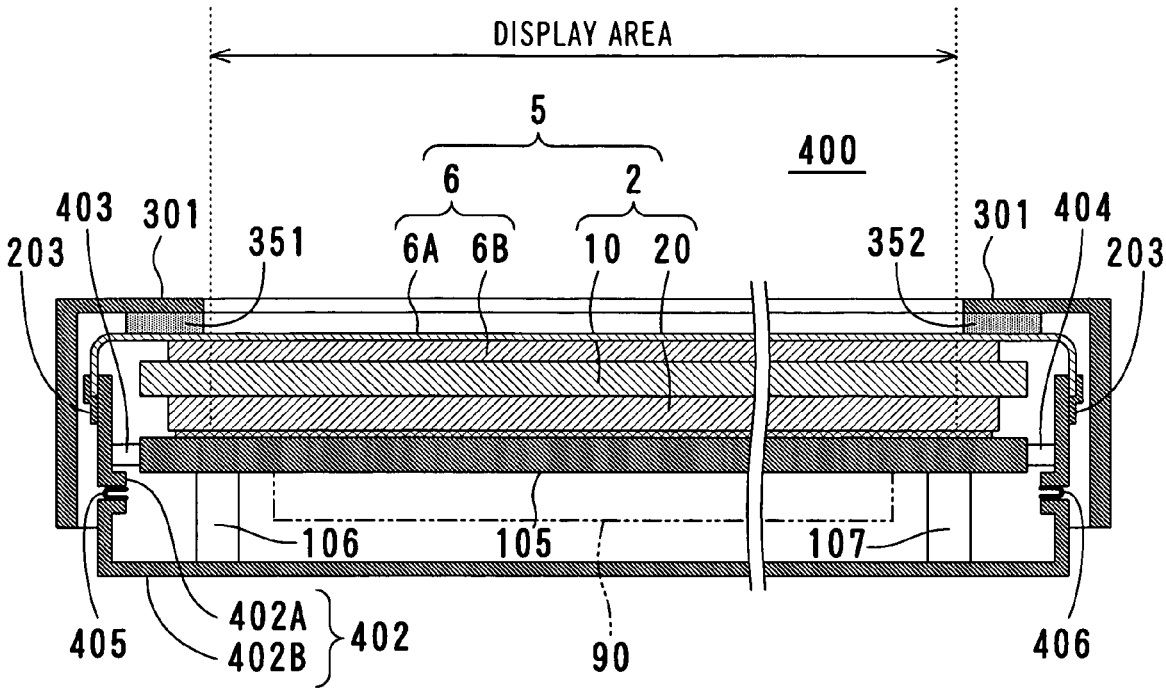
FIG. 13 shows a fourth example of a structure of the display device.

FIG. 13 shows a fourth example of a structure of the display device. A structure of the display device 400 is substantially the same as the above-mentioned display device 300. The display device 400 is characterized in that the conductive housing 402 includes a frame-like structure 402A that is a front portion thereof and a box-like structure 402B that is a rear portion thereof. The structure 402A is fixed to the chassis 105 via insulator spacers 403 and 404, and a rim portion of the front sheet 6 is fixed to the structure 402A via the pressure member 203. The structure 402B and the facing cover 301 are attached to the panel module in which the display panel device 5, the chassis 105 and the structure 402A are integrated. When attaching the structure 402B, connection members 405 and 406 are used for securing conductive connection between the structure 402A and the structure 402B.

In the fourth example, cost of the panel module can be reduced by optimal design of the structural elements of the panel module on the common concept. In a manufacturing form that a device manufacturer and a set manufacturer complete the display device 400, it is possible to incorporate the entire or a part of the electric circuit including a power source into the panel module, or it is possible that the set manufacturer attaches a part or the entire of the electric circuit to the panel module together with the facing cover 301.

According to the above-mentioned first through fourth examples, the conductive mesh 322A that passes light and the looped conductive member 322B that surrounds the conductive mesh 322A are formed integrally in the conductive layer 322 of the electromagnetic wave shielding layer 320, so cost of the display panel device 1 or 5 can be reduced compared with the structure in which a conductive tape is attached around the mesh made of woven conductive fibers.

According to the above-mentioned first through fourth examples, end portions of the front portion 3A or 6A of the front sheet 3 or 6 protrude from the rear portion 3B or 6B by 1 cm or more so that the protruding portions can be used for gripping when peeling the same. Namely, it is easy to peel the front sheet 3 or 6 from the plasma display panel 2, so that the peeling process can be mechanized at low cost.

The above-mentioned embodiments have the following variations.

As the electromagnetic wave shielding layer 320 having translucency and conductivity, a multilayered silver film can be incorporated instead of the mesh. The multilayered silver film has a function of interrupting infrared rays, so the infrared absorption coloring matter is not necessary for forming the optical film layer 310. Concerning the coloring layer 313, a multilayered structure having plural layers including different coloring matters can be adopted instead of the single layered structure.

The most rear face of the front sheet 3 or 6 can be formed as an adsorption surface having a self adsorption function. For example, after forming the impact absorbing layer 351, a film made of a silicone material is formed on the surface of the impact absorbing layer 351. Thus, it is possible to repeat peeling and sticking between the front sheet 3 or 6 and the plasma display panel 2 many times. This can reduce a loss of the display panel device during manufacturing process and also contribute to maintenance after it is assembled to the display device. It is because that the front sheet can be replaced easily when it is damaged. It is also possible that only the anti-reflection layer 312 is made as a sheet having the self adsorption function and is glued on the remaining portion of the front sheet 3 or 6. In this case, the anti-reflection layer 312 may be glued in a step other than the step of gluing the remaining portion of the front sheet 3 on the plasma display panel 2, so that a size thereof may be different from a size of the electromagnetic wave shielding layer 320. A strength of the adsorption is desirably adjusted so that peeling can be done only by a force applied in the perpendicular direction, and the adsorption force is desirably 4N/25 mm or less (when peeling speed is 50 mm/min).

Instead of a silicone material, an acrylic foam material that is similar to the material of the impact absorbing layer 351 may be used, and similar effect can be obtained.

Note that a cleaning process such as using water or air injection should be performed prior to gluing the front sheet 3 or 6, if necessary, and such cleaning process should also be performed on an adsorption surface when a peeled front sheet is reused.

It is useful to design a red color fluorescent material (for example, (Y, Gd, Eu)PVO4) and a discharge gas (for example, Ne—Xe gas having Xe ratio of 5% or more and gas pressure of 500 Torr , and Xe partial pressure of 20 Torr or more) of the plasma display panel 2 appropriately so as to reduce quantity of orange color light. If an optical filter having a narrow wavelength range of absorbing orange color light selectively can be eliminated, cost of the front sheet 3 can be reduced more.

A material of the conductive housing 102, 202 and 402 is not limited to a metal sheet, and it can be a resin sheet on which a conductive material is coated, a resin sheet on which metal foil or metal fibers are applied or other material that has at least a part of the surface or the inner portion has conductivity to be suitable for shielding electromagnetic waves. It is not necessary that the structure 402A and the structure 402B of the conductive housing 402 are made of the same material in the fourth example.

Although a plasma display panel is exemplified in the above description, the device constituting a screen is not limited to the plasma display panel, and the present invention can also be applied to devices in which other display panels including an EL (Electro Luminescence), an FED (Field Emission Display) and a liquid crystal display constitute screens. In particular, the present invention is suitable for a device that is required to shield electromagnetic waves.

The present invention is useful for reducing cost of a display panel having a front sheet, which contributes to providing a display device having a large screen and a light weight.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A display panel device comprising:

a display panel with a screen; and a front sheet that is glued on a front face of the display panel, wherein the front sheet includes a front portion having a plane size that is larger than a plane size of the display panel and a rear portion that contacts the front portion, the front portion is constituted of plural layers, each layer having the same plane size and a different function, the front portion is coupled to the front face of the display panel through the rear portion, the rear portion has a plane size that is larger than a plane size of the screen and smaller than the plane size of the display panel, a layer of the plural layers that contacts the rear portion is an electromagnetic wave shielding layer that is configured to shield electromagnetic waves radiated from the display panel, the rear portion is formed from a single material that has a higher adhesion to the electromagnetic wave shielding layer than to the front face of the display panel, and a part of the electromagnetic wave shielding layer extends beyond the display panel in a plane view so as to enable contact between the electromagnetic wave shielding layer and an external conductor at an extended portion of the electromagnetic wave shielding layer.

2. The display panel device according to claim 1, wherein a thickness of each of the plural layers of the front portion is less than or equal to 500 micrometers.

3. A display panel device comprising:

a plasma display panel with a screen; and a front sheet that is glued on a front face of the plasma display panel, wherein the front sheet includes a front portion having a plane size that is larger than a plane size of the plasma display panel and a rear portion that contacts the front portion, the front portion is constituted of plural layers, each layer having the same plane size and a different function, the front portion is coupled to the front face of the plasma display panel through the rear portion, the rear portion has a plane size that is larger than a plane size of the screen and smaller than the plane size of the plasma display panel, a layer of the plural layers that contacts the rear portion is an electromagnetic wave shielding layer that is configured to shield electromagnetic waves radiated from the plasma display panel, the rear portion is formed from a single material that has a higher adhesion to the electromagnetic wave shielding layer than to the front face of the plasma display panel, and a part of the electromagnetic wave shielding layer extends beyond the plasma display panel in a plane view so as to enable contact between the electromagnetic wave shielding layer and an external conductor at an extended portion of the electromagnetic wave shielding layer.

4. The display panel device according to claim 3, wherein the front portion of the front sheet is made of a multilayered film, and the rear portion of the front sheet is made of a resin applied on the front portion.

5. The display panel device according to claim 3, wherein the rear portion of the front sheet is made of a material softer than the front portion, and the rear portion has a function of absorbing impact.

6. The display panel device according to claim 3, wherein the electromagnetic wave shielding layer includes a conductive mesh covering the screen and a looped conductive member surrounding the conductive mesh.

7. The display panel device according to claim 3, wherein the electromagnetic wave shielding layer has a conductive mesh covering the screen and a looped conductive member surrounding the conductive mesh, and a rim of the rear portion of the front sheet is put on the looped conductive member of the electromagnetic wave shielding layer along the entire rim.

8. The display panel device according to claim 3, wherein the electromagnetic wave shielding layer is a uniform conductive layer put on the screen, and a part of the uniform conductive layer extends beyond the rear portion so as to be exposed.

9. The display panel device according to claim 3, wherein the front sheet is glued on the front face of the plasma display panel so that the front sheet can be peeled off.

10. The display panel device according to claim 3, wherein the front sheet is glued on the front face of the plasma display panel by adsorption.

11. A display device comprising:

a display panel; and a functional film arranged on a display surface of the display panel in intimate contact, wherein the functional film is made of a layered film including an optical functional film that is configured to filter light emitted from the display panel and an electromagnetic shielding film having a conductive layer for shielding electromagnetic waves radiated from the display panel, a plane size of the electromagnetic shielding film is larger than a plane size of the display panel, the optical functional film and the electromagnetic shielding film have the same size in at least one of a horizontal direction and a vertical direction of the display surface of the display panel, the electromagnetic shielding film is disposed more closely to the display panel than the optical functional film, the conductive layer of the electromagnetic shielding film is arranged on the display surface in intimate contact, the functional film is brought into intimate contact with the display surface of the display panel via a flexible transparent layer that is disposed between the electromagnetic shielding film of the functional film and the display surface, the flexible transparent layer is a coupling layer between the functional film and the display surface of the display panel and is formed from a single material that has a higher adhesion to the electromagnetic wave shielding layer than to the front face of the display panel, and a part of the conductive layer extends beyond the display panel in a plane view so as to enable contact between the conductive layer and an external conductor at an extended portion of the conductive layer.

12. The display device according to claim 11, wherein the functional film is formed by cutting a continuous band-like layered film in which plural functional films are connected in series at a pitch of the common size along the longitudinal direction of the continuous band-like layered film.

* * * * *